United States Patent [19]

Wenzlick et al.

[11] Patent Number: 4,579,402

[45] Date of Patent: Apr. 1, 1986

[54] PLASTICS DRAWER FOR FURNITURE

[75] Inventors: Erich Wenzlick, Durlangen; Hermann Rothfuss, Waiblingen, both of Fed. Rep. of Germany

[73] Assignee: BBP-Kunststoffwerk Marbach Baier GmbH und Co. KG, Marbach, Fed. Rep. of Germany

[21] Appl. No.: 589,665

[22] Filed: Mar. 14, 1984

[30] Foreign Application Priority Data

Mar. 15, 1983 [DE] Fed. Rep. of Germany ... 8307469[U]

[51] Int. Cl.[4] ..... A47B 88/04

[52] U.S. Cl. ..... 312/330 R; 312/341 R

[58] Field of Search ..... 312/341 R, 341 NR, 330 R, 312/348, 333

[56] References Cited

U.S. PATENT DOCUMENTS

| | | | |
|---|---|---|---|
| 3,377,115 | 4/1968 | Hansen et al. | 312/330 R |
| 3,826,554 | 7/1974 | Cornell | 312/336 |
| 4,067,632 | 1/1978 | Sekerich | 312/348 |
| 4,173,380 | 11/1979 | Dupree | 312/346 |
| 4,230,382 | 10/1980 | Wenzlick | 312/330 |

FOREIGN PATENT DOCUMENTS 7900396 6/1980 Fed. Rep. of Germany .

*Primary Examiner*—William E. Lyddane
*Assistant Examiner*—Joseph Falk
*Attorney, Agent, or Firm*—Michael J. Striker

[57] ABSTRACT

In a drawer formed of plastics and including a bottom, a front wall and a rear wall each double-wall side wall includes an inner wall and an outer wall spaced from the inner wall to include therebetween a hollow space shaped as inverted U. This hollow space is enclosed at the bottom end thereof with a ledge member. The ledge member includes an upper horizontal arm which extends from the inner wall to the outer wall of each side wall, and a vertical arm integral with the upper arm and provided with clamping tongues engageable in respective recesses formed in an extension of the inner wall. The drawer is further provided with engagement elements for fastening a front facing to the front wall of the drawer. Each engagement element includes a clamping lug and a bolt rotated to translate the axial movement of the bolt into the transverse movement of the lug towards the front wall.

29 Claims, 9 Drawing Figures

VI
VII
VIII
b

PLASTICS DRAWER FOR FURNITURE

BACKGROUND OF THE INVENTION

The present invention relates to a plastic drawer for furniture.

Drawers made out of plastics and slidable in openings provided in articles of furniture are known in the art. One of the drawers of the type under discussion is disclosed in U.S. Pat. No. 4,173,380. In the drawer shown in this patent a guide ledge member, which is mounted in the space between each pair of side walls, is of a complex and expensive construction and formed with a releasably-detachable metallic guide rail. The structure of the ledge member made of plastics has a ledge-shape and in the lower region is formed as a laterally open "U", the ledge member therefore has window-like-shaped wall portions, which are inserted into a hollow space between the inner wall and the outer wall of each side wall, and is there attached to the outer lateral faces of the walls by a form-locking connection. The fastening of the ledge member of plastics in the hollow space of the side wall is obtained by means of glue or welding and also by an additional form-locking means. The metallic guide rail is applied to the ledge member in the region of the open side thereof. The rail has a cross-section, for example corresponding to the U-shaped ledge member. In the known design a special adjustment member is provided for the guide rail for fastening to an article of furniture so that the furniture-side guide rail could be inserted into the guide rail positioned in the ledge member. The drawer disclosed in U.S. Pat. No. 4,173,380 is heavy and expensive in manufacturing. The plastics element inserted in the hollow space of each side wall and serving as an of adapter for receiving the guide rail requires a special extrusion die which is expensive.

This adaptor element not only enhances costs of manufacturing of the drawer but also considerably increases the weight of the drawer. Furthermore, a specially designed guide rail is also expensive in manufacturing. Also expensive is the guide rail provided on the article of furniture particularly when a special adjustment or adaptor member is required.

SUMMARY OF THE INVENTION

It is an object of the present invention to provide an improved drawer for an article of furniture.

It is another object of the present invention to provide a drawer which is inexpensive and requires no special adjustment members when applied to the article of furniture.

These and other objects of the invention are attained by a drawer, made of plastics material, for furniture, comprising a front wall, a rear wall, a bottom, a pair of side walls each being a double wall and including an inner wall and an outer wall spaced from each other to form a hollow space therebetween, having a reverse-U cross-section, and a guide ledge member in each side wall mounted thereon to enclose said hollow space at a lower end thereof, said ledge member extending in the direction of elongation of the assigned side wall at least along the entire length of said hollow space and in a direction transverse to the direction of elongation from said inner wall to said outer wall, said inner wall having a first inner face facing said hollow space and said outer wall having a second inner face facing said hollow space, said first inner face and said second inner face being smooth and rib-free, said ledge member including an upper horizontally extending arm projecting from said inner wall to said outer wall, said ledge member being free of portions extending upwardly of said upper arm into said hollow space and being releasably connected to said inner wall in the region of said bottom wall by a force-locking or form-locking connection, said upper arm having an underside forming a guide surface for guiding thereon a guide means connected to an article of furniture.

The ledge member may be formed of metal.

The guide means connected to an article of furniture may be a roll, said roll being adapted to ride on said guide surface so that no additional adjusting elements on the drawer in the regions of longitudinal side walls are required. Some adapter elements on the furniture-side guide rail are necessary. Such elements can be have a U-shape and can be applied immediately to the article of furniture.

In the drawer according to the invention a sufficient rigidity is warranted even without additional adaptor members on the guide means of the drawer.

The ledge member may have a vertically extending arm integral with said upper arm and projecting downwardly therefrom towards said bottom wall at least up to the level of said bottom wall, said vertical arm having a smooth face abutting against said inner face of said inner wall.

The outer wall spaced from the inner wall is somewhat prestressed at its lower edge where it lies against the upper arm. Thereby breaking of the outer wall and its bending towards the inner wall due to manufacturing by injection molding is prevented. It is also warranted that the upper horizontal arm of the ledge member uniformly extends between lateral faces of the outer and inner wall. Loading forces exerted on the drawer and which should be translated to the article of furniture through the guide means will be taken directly by the ledge members in the lower area of the drawer and translated via the respective upper arms of the ledge members directly onto the guide rails on the furniture.

The inner wall may have an extension projected downwardly beyond said bottom wall.

The ledge member may have a lower horizontally extending arm integral with said vertically extending arm so that said ledge member has an S-shaped cross-section, said extension having an underside engaged with said lower arm.

Although plastics or wood are recommended for the ledge members the ledge members of the proposed invention are preferably formed of a steel sheet profile which can be relatively inexpensive and has a good rigidity. It is also advantageous that fastening of the ledge members to the drawer has no problems. This is obvious when the ledge members are applied to the drawer rather than to the article of manufacture.

The drawer may further include means for force-locking connection of said ledge member to said inner wall said means including punched-out and bent clamping tongues formed on said ledge member and said extension having recesses in which said tongues are engaged whereby said ledge member is releasably connected to the drawer.

The clamping tongues may be open in the horizontal direction towards said front wall and each have a clamping portion received in the respective recess, said recesses being formed as openings open at the underside of said extension so that the clamping portion of each tongue is inserted from below into the respective opening.

Each ledge member flatly lies against the respective surfaces of the drawer and a reliable fixing as well as large overlapping surfaces between the ledge members and the drawer are provided.

A further advantage of the fastening means on the ledge members is that the ledge members can be easily released from the drawer when the drawer inserted into the furniture article should be separated from the ledge members. This presents no difficulties to a user. The drawer then should be lifted upwardly from the ledge member and after releasing the hook-like portions of the tongues from the recesses the drawer should be pulled forwardly to overcome the initial fastening. Conventional locking means, such as elastic locking means, namely balls, tongues, cams or the like, cooperating with respective drawer portions can be provided.

The objects of the present invention are also attained by a drawer, made of plastics material, for furniture, comprising a bottom, a front wall, a rear wall and a pair of side walls, a substantially smooth adjustable front facing releasably connected to said front wall, said front wall having an inner wall portion, and at least two connecting means each mounted at the end of the front wall and including an engagement member extended between said front facing and said inner wall portion and including a vertically extended rear engaging arm parallel to said wall portion, and a rotatable pin extended transversally of the drawer and acting upon the rear engaging arm upon attaching said front facing to said front wall, said pin being a bolt, said drawer being formed with two supporting wall portions having bores spaced from each other in the direction of the axis of said bolt, said bolt being supported in said bores and including a circumferential outwardly radially extending portion, each connecting means further including a clamping lug mounted between said rear engaging arm and said circumferential outwardly radially extending portion of said bolt whereby upon rotation of said bolt for attaching said front facing to said front wall an axial movement of said bolt is translated via said circumferential outwardly extending portion into a motion of said rear arm in the direction normal to said axial movement and towards said inner wall portion of said front wall.

The connecting mean with engagement members for connecting the front facing to the front wall of the drawer are disclosed, for example in DE-GM 7,900,396. Each pin in the known drawer is engaged immediately with the engaging arm of the engagement member connected to the front facing, that pin being formed by an eccentric pin having a flattened circumference, the flat portion of which cooperates with the engaging arm of the engagement member. The rear side of the front facing in the known drawer is pulled to the surfaces of the drawer. This can cause deformations of these surfaces of the drawers. The design of the connecting means having eccentric pins is disadvantageous because no reliable and smooth clamping and fastening along the plane of the front facing before adjusting of the front facing to the front wall of the drawer are warranted.

The drawer including proposed connecting means for fastening the front facing to the drawer is easy to handle and inexpensive in manufacturing. Such a drawer provides for a reliable and smooth fastening of the front facing to the front wall of the drawer without any delays.

According to further features of present invention the bolt in each connecting means may have an outer end accessible in the region of the respective side wall and has a threaded portion supported in one of said bores.

Each bolt may have at the outer end thereof a head, one of said supporting wall portions having a surface limiting the movement of the head of said bolt in the axial direction.

The inner wall portion may have a front face facing said rear arm and engageable therewith, said lug extending parallel to said rear arm and being engageable therewith upon the axial movement of said bolt, The front face of the inner wall portion may be provided with grooves alternating with projections and said lug having respective grooves alternating with projections and engageable with the grooves and projections of the inner wall portion.

The lug may be provided with grooves alternating with projections and said rear arm at a side thereof facing said lug having grooves alternating with projections and engageable with the respective grooves and projections of the lug.

The aforementioned circumferential portion may be provided with at least one thread thereon, said thread being cut into the material of said lug whereby the latter will be displaced towards said rear arm and said inner wall portion.

The circumferential radially outwardly extended portion of said bolt may be also formed by a conical portion which tapers in the direction of said axial movement, said lug having a conical contact surface engageable with said conical portion.

The engagement member may further include a horizontally extended upper arm integral with said rear arm and a vertically extended front arm integral with said upper arm and spaced from said rear arm so that the engagement member has a cross-section of inverted U.

Dowels or bolts may be provided for connecting said front facing to said engagement member.

The connecting means according to the invention, utilized for fastening the front facing to the drawer make possible an adjustment of the front facing along the plane of the same and provide for an easy and quick fastening of the front facing without requiring professional skills for users or any special tools. If the bolt can engage immediately with the rear arm of the engagement member it is preferable, however to have a clamping lug which cooperates with the rear engaging arm of the engagement member and acted upon by the aforementioned circumferential outwardly extended portion of the bolt. Due to the connecting means according to the invention damage to and deformations of the front wall of the drawer are avoided.

It is to be further noted further that because no additional adapter members are required on the drawer side of the drawer according to the invention the hollow space between the inner and outer wall of each side wall of the drawer remains free.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
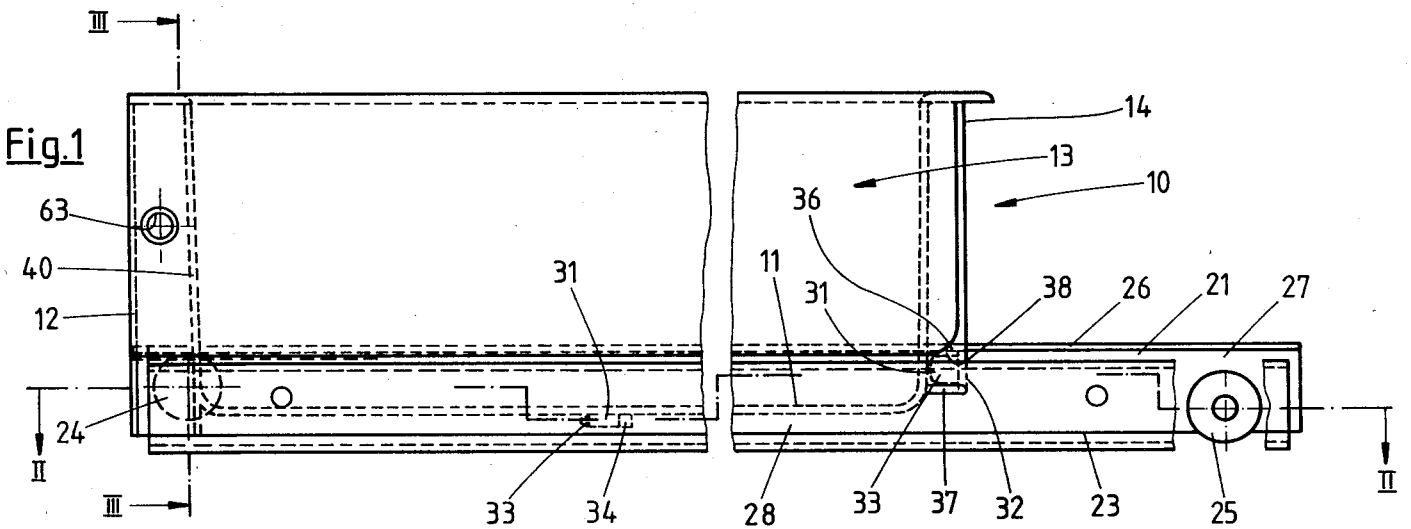
FIG. 1 is a schematic side view of the drawer for an article of furniture.
Figure 2:
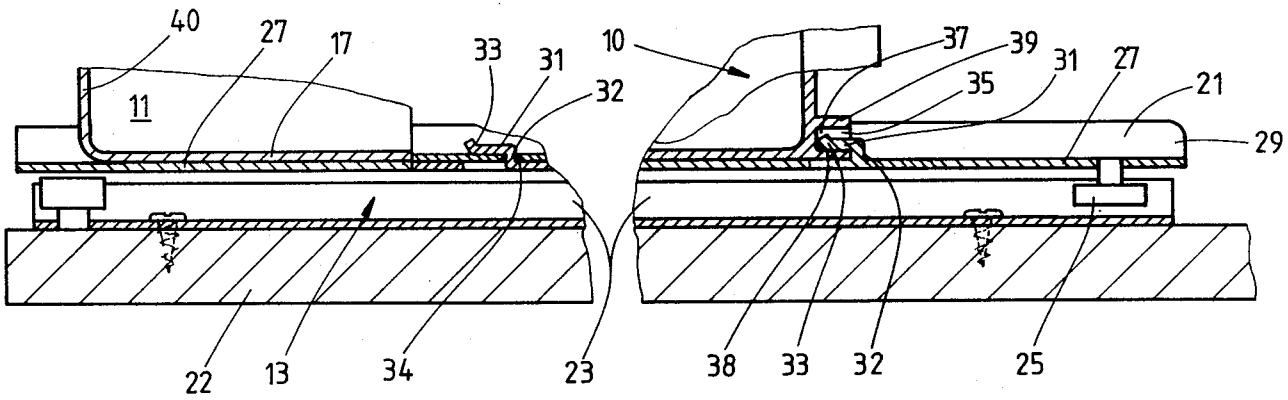
FIG. 2 is a partial sectional view taken along line 11—11 of FIG. 1.
Figure 3:
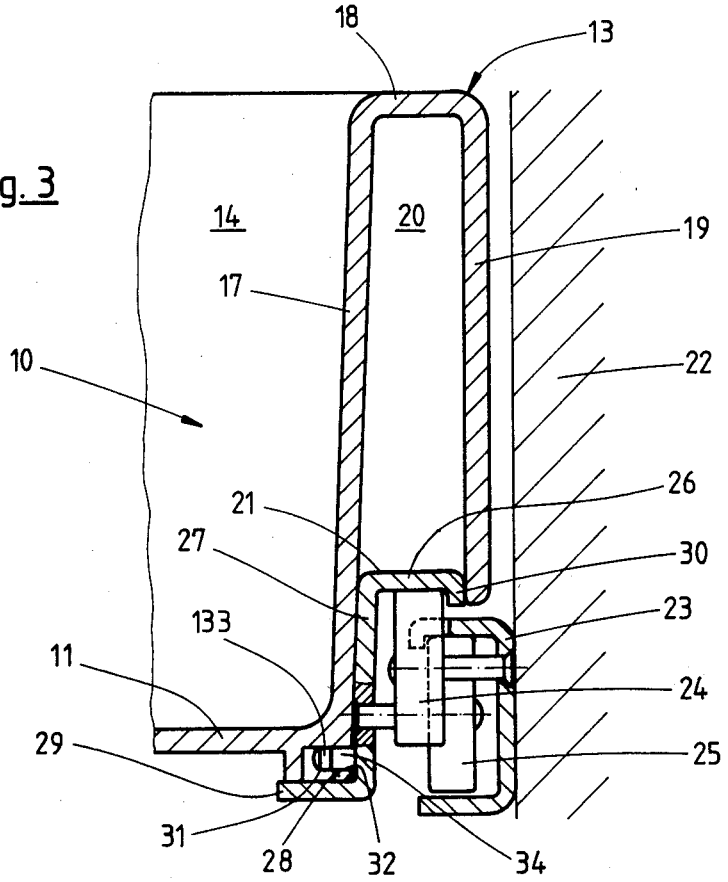
FIG. 3 is a partial sectional view taken along line III—III of FIG. 1.

Referring now to the drawings in detail, and first to FIGS. 1–3 thereof, these figures show a first embodiment of the design of the ledge of the drawer for an article of furniture, which drawer is made of plastics. The drawer is comprised in the known fashion of a bottom wall 11, front wall 12, longitudinal side walls 13 and a rear wall 14, all formed by injection molding. Bottom wall 11, front wall 12 and all remaining walls 13 and 14 are formed as one piece. A front facing 16, which is plate-shaped and made out for example of wood, is fixed to the front wall 12.

As seen from FIG. 3 each longitudinal side wall 13 is double-walled and includes an inner wall 17 and an outer wall 19 interconnected by an upper end wall 18 to form a one-piece element. Thereby the cross-section of each side wall 13 is an invested U and a hollow space 20 open in the downward direction is constituted between walls 17 and 19. A guide ledge 21 which is made of steel sheet profile is mounted at the lower end of the hollow space 20.

A furniture-side guide rail 23 corresponding to the guide ledge 21 is rigidly connected to an article of furniture 22 into which the drawer passes. The guide rail 23, which in the exemplified embodiment has the shape of U open leftwardly, carries at the front end thereof a roll 24 rotatable about a horizontal axis and which serves as a furniture-side guide means. Roll 24 extends through an opening formed in the upper arm of guide rail 23 upwardly towards the lower side of the drawer. The guide rail 23 is in the known fashion fastened to the article of furniture 22 by screws.

Each drawer-side guide ledge 21 extends along the entire assigned side wall 13 and projects rearwardly beyond the rear wall 14 as shown in FIGS. 1 and 2. At the rear end thereof carries guide ledge 21 a roll 25 rotatable about a horizontal axis; roll 25 rides on the lower arm of the U-shaped furniture-side guide rail 23 whereas roll 24 rides on the guide rail 23 at the front end of this rail. If the drawer is pulled out from the furniture piece 22 loading forces exerted on the drawer are distributed so that the rear roll 25 will move towards the upper arm of guide rail 23 and ride against that upper arm. Such a guiding arrangement with a roll adapted to abut against two opposite arms of the rail periodically is known in the art.

The guide ledge 21 in the transverse direction extends between the inner wall 17 and the outer wall 19 whereby it abuts against two opposite inner faces of those walls without, however, being fixed to those walls by glueing or any other similar means.

In the embodiment shown in FIGS. 1 through 3 the guide ledge 21 has a cross-section of the angular profile with an upper horizontal arm 26 connected to a vertical arm 27 and another horizontal arm 29. Vertical arm 27 extends downwardly beyond bottom wall 11. As seen from FIG. 3 the inner wall 17 of side wall 13 has an extension 28 which projects beyond bottom wall 11 in the downward direction. The end face of extension 28 is engaged with the upper surface of second horizontal arm 29 of the guide ledge 21, which arm projects leftwardly from arm 27. The ledge has in cross-section an S-profile in the embodiment of FIG. 3.

Figure 4:
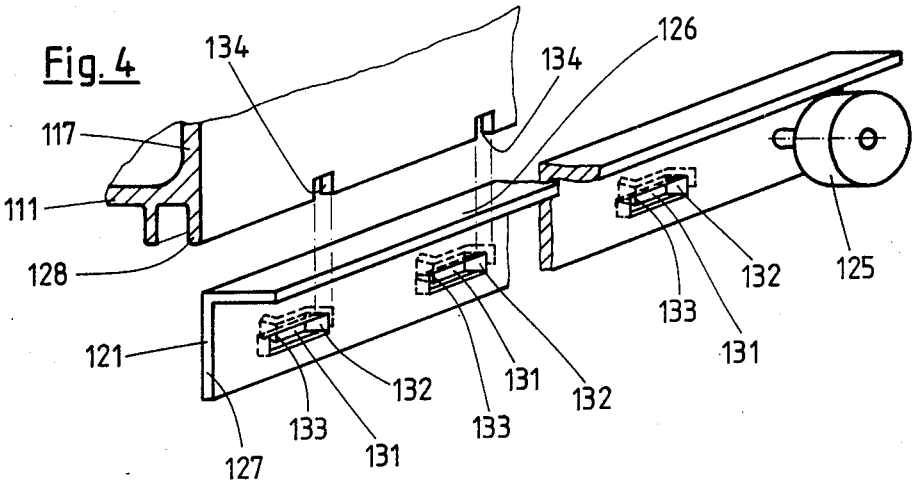
FIG. 4 is an exploded perspective view of the guide ledge and the side wall of the drawer according to another embodiment of the invention.

In the embodiment illustrated in FIG. 4 the structural elements similar to those of FIGS. 1–3 are denoted by the same numbers but multiplied by 100. The difference between the guide ledge 121 and guide ledge 21 of FIG. 3 is that guide ledge 121 is an angular member with only one horizontal arm 126 and vertical arm 127.

The inner wall 17 and outer wall 19 which form therebetween the hollow space 20 are smooth and rib-free. These walls have no extensions or deformed projections. If with conventional structures of guide ledges for drawers an adapter element fixed to the drawer is required in the region of hollow space 20 no such an adapter is needed in the proposed invention. In place of such an adapter the guide ledge 21 formed of steel sheet profile is directly fastened to the drawer so that the latter is inexpensive and simple. The guide ledge 21 is also free of any parts projecting upwardly into space 20. The upper arm 26 extends in space 20 from wall 17 to wall 19. Furthermore, as seen from FIG. 3 the horizontal upper arm 26 has an extension or abutment 30 projected downwardly. This abutment enhances rigidity of the ledge and provides for a substantially large supporting area on outer wall 19. Such an abutment is not, however, necessary as illustrated in FIG. 4.

The horizontal arm 26 or 126 has on the lower side thereof a guide surface with which furniture-side roll 24 is in engagement. The guide ledge 21 is connected to the drawer by force-locking or form-locking connection in such a manner that it can be easily attached to or released from the drawer. Inasmuch as inner wall 17 should not have perforations or openings, it has the extension 28 projected downwardly from bottom wall 11 as has been mentioned above. It is important that vertical arm 27 or 127 be sufficiently long to provide a sufficiently large surface of abutting against inner wall 17 or 117 and have a surface of contact with extension 28 or 128.

Various means can be utilized for fastening guide ledge 21 or 121 to the drawer. In the proposed invention hookshaped clamping tongues 31 or 131 bent towards the extension 28 or 128 are provided on the guide ledge 21 or 121 in the embodiment of FIG. 3 or FIG. 4. These tongues are formed by stamping-out and bending of angular portions of the ledge in the direction of the extension 28 or 128 or the inner wall 17 or 117 of the side wall 13. Each clamping tongue 31 or 131 is oriented in the horizontal direction and is open forwardly.

Each clamping tongue 31, 131 has a clamping tongue portion 32 or 132 which extends at right angles to the vertical arm 27 or 127 towards extension 28, 128. A hook-like portion 33, 133 is projected leftwardly from the clamping portion 32, 132. As can be seen from FIG. 4 wall extension 28 or 128 has at the level of clamping portion 32 or 132 a number of recesses 34 or 134 which open in the downward direction to receive respective clamping portions 32, 132 therein. When clamping portions 32, 132 are engaged in respective recesses 34, 134 from below the hook-like portions 33, 133 extended parallel to the vertical arm 27, 127 overlap the corresponding side of wall extension 28, 128 and are hooked behind this wall extension. Thereby each clamping portion 32, 132 which is inserted into the respective recess 34, 134 in the vertical direction from below abuts against the base of the respective recess. The drawer 10 is also fixed in the downward direction. Since the recess or slot 34, 134 is engaged at both side walls thereof with the clamping portion 32, 132 a form-locking connection is obtained in the direction of pulling out of the drawer from the furniture article as well as in the opposite direction. Inasmuch as the hook-like portion 33, 133 overlaps the wall extension 28, 128 and since the arm 27, 127 of guide ledge 21, 121 flatly abuts against the face of inner wall 17 a reliable fastening of the drawer 10 in the horizontal direction which is transversal to the direction of pulling the drawer out from the article of furniture is obtained. Therefore a rigid connection between the guide ledge 21 and drawer 10 is achieved by very simple means.

It is to be understood that the drawer 10 can be supported on the upper narrower sides of the respective bent hook-like portions 33 or 133 of clamping tongues 31, 131.

With reference to FIGS. 1 and 2 it will be seen that drawer 10 in the region of its rear wall 14 has a somewhat box-shaped rounded recess or opening 35 open in the rearward direction. This recess 35 is formed by an upper wall 36, lower wall 37, a rear-side wall-extension 38 and wall 39 extending parallel to extension 38 and at a distance therefrom. The hook-like portion 33 of the aforementioned clamping tongue 31 of guide ledge 21, formed in the region of rear wall 14 is engaged in recess 35 so that portion 33 is held in the vertical direction between the upper wall 36 and lower wall 37 and in the horizontal direction this portion is engaged on the rear-side wall extension 38. Thereby a reliable fastening of ledge 21 in the region of rear wall 14 is also obtained with simple means.

Arresting or locking means, such as hooks, spring strips, projections or the like which would be elastically interlocked with each other when the guide ledge is in a correct position can be provided between drawer 10 and guide ledge 21 in the front region of the drawer. Such arresting means can be any suitable conventional means and are not shown herein.

In order to fasten drawer 10 to guide ledge 21 the rear clamping tongue 31 is first hooked in the recess 35. Thereby guide ledge 21 and the lower edge of wall extension 28 form in assembly a profile of somewhat forwardly open U. Thereafter drawer 10 and guide ledge 21 are moved towards each other unless clamping portions 32, 132 become engaged from below in respective slots or recesses 34, 134 of wall extension 28, 128 and hook-like portions 33, 133 then become laterally bent so that they are elastically clamped on the opposite side of wall extension 28, 128. After locking of the ledge 21 on drawer 10 by non-illustrated locking means provided in the front region of the drawer the latter is rigidly connected to guide ledge 21. The guide ledge then always takes up forces exerted on the drawer, particularly the weight of the loaded drawer as well as forces exerted on the drawer when the latter is in an extended position. Due to horizontal arm 26 extended from wall-to-wall the outer wall 19 is reliably held at the distance from inner wall 17 and is so supported in the transverse direction that a closed, straight-line design of each side wall 13 is obtained over the entire length of the drawer. It is particularly advantageous that a very rigid construction of drawer 10 as compared to those known in the art is obtained by very simple and inexpensive means.

Owing to abutment or projection 30 bent in the downward direction on the horizontal arm 26 a supporting of the drawer 10 in the transverse direction in respect to roll 24 is provided. It is sufficient to provide the abutment 30 only on one side wall 13, for example the right-hand side wall, for example as shown in FIG. 3. The left-hand, non-visible guide ledge can be formed without abutment 30 and without second horizontal arm 29 such as shown in FIG. 4.

It is a further advantage of the proposed design that because of U-shaped profile of the furniture-side guide rail 23 the latter can be fastened to the article of furniture 22 immediately by bolts without requiring usual special adjustment members to be wedged to the article of the furniture. This can substantially reduce manufacturing costs of the drawers.

In the embodiment of ledge 21 with the additional horizontal arm 29 the guide ledge additionally seizes the drawer from below. Furthermore, a groove is formed between the ledge and bottom wall 11 of the drawer, in which groove an antinoise compound below wall 11 can be inserted whereby bottom wall 11 will be reinforced and undesired noises due oscillations of bottom wall 11 will be prevented from occurrence.

It is to be understood that a simple angular L-shaped profile of guide ledge 121 as depicted in FIG. 4 is sufficient to provide for a rigid and reliable guide ledge. Although it is advantageous that the guide ledge 21 or 121 is made out of metal, for example steel sheet profile, the guide ledge can be also formed of plastics. In another non-illustrated embodiment clamping tongues 31, 131 can be directed vertically whereas hook-like portions 33, 133 can be oriented upwardly. Then instead of the upper narrower surfaces of clamping portions 32, 132 their wider surfaces will engage in corresponding slots or recesses 34, 134 and a form-locking connection in the direction of pulling-out of the drawer as well as in the opposite direction will be obtained so that the both lateral walls forming recesses 34, 134 will lie on the vertically extended small surfaces of clamping portions 32, 132. Of course, it is understandable that any other form-locking means for connecting the ledge to the drawer can be utilized; one or a number of bolts can be finally used in the assembly, which would be inserted through vertical arm 27, 127 of the guide ledge into the wall extension 28, 128.

Figures 5, 7, 8:
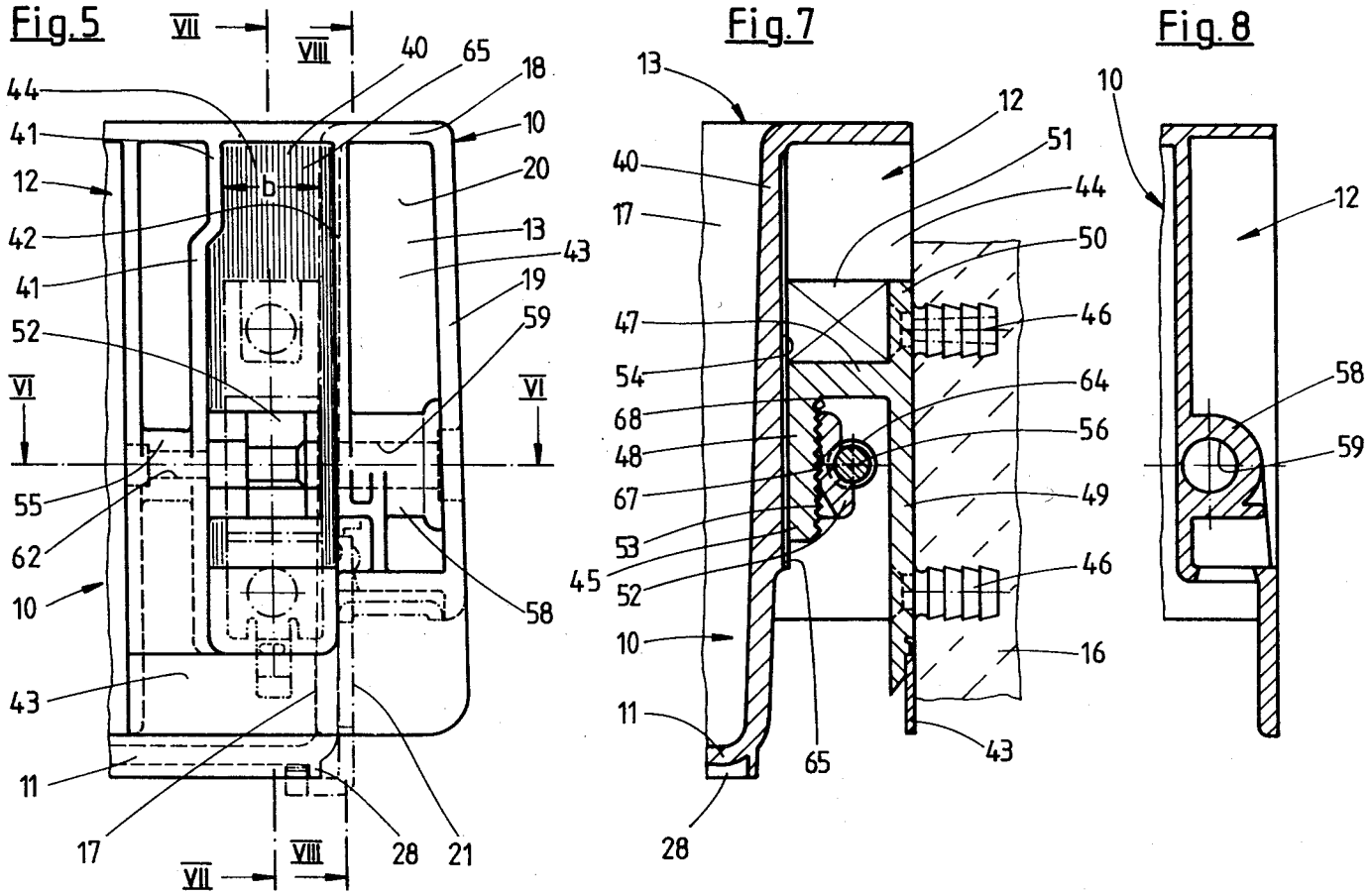
FIG. 5 is a partial front view of the right-hand end portion of the drawer.
FIG. 7 is a partial sectional view taken along line VII—VII of FIG. 5.
FIG. 8 is a partial sectional view taken along line VIII—VIII of FIG. 5.
Figure 6:
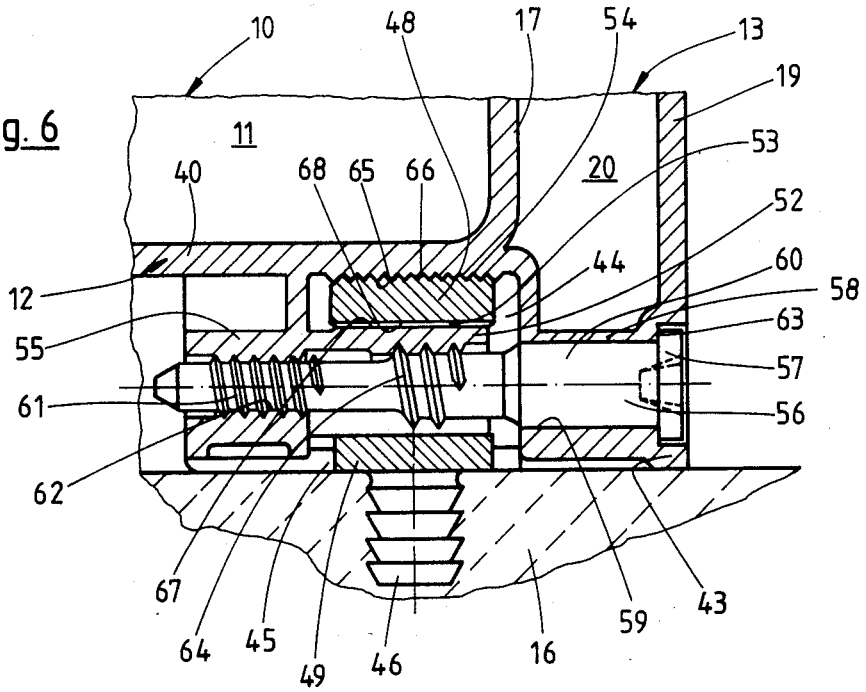
FIG. 6 is a partial sectional view taken along line VI—VI of FIG. 5.

FIGS. 5 through 8 illustrate fastening means for connecting a front facing 16 to the front wall 12 of the drawer. Two similar fastening means are provided at two opposite ends of front wall 12. The front wall 12 has an inner wall portion 40 which is integral with bottom wall 11 and inner wall 17 of each side wall 13. From wall portion 40 are extended a web 41, a web 42 and a wall section 43, to which front facing or shield 16 is applied. As seen from FIG. 6, which illustrates the right-hand end region of front wall 12, front facing 16 is in contact with the wall section or portion 43. The left-hand end region of front wall 12 is formed similarly. With reference to FIG. 4 it is seen that a somewhat rectangular opening is constituted between two upper webs 41, 42 and the lower wall portion 43. An engagement element 45 is connected to the front facing 16 in the corresponding area thereof by means of studs or dowels 46, or bolts as shown in FIGS. 6 and 7. The engagement element 45 is made of plastics. This engagement element has an approximately inverted-U cross-section and is formed with a horizontal engaging arm 47, vertical front arm 49 and another vertical rear engaging arm 48 which is parallel to and is horizontally spaced from arm 49. Both vertical arms 48 and 49 extend in the downward direction; outer arm 49 is rigidly connected to front facing 16. The outer or front arm 49 has an extension 50 which overlaps the horizontal engaging arm 47 whereby an angular space is formed between wall extension 50 and arm 47 in which ribs 51 for reinforcing the engagement element 45 are provided. Outer arm 49 is longer than the rear engaging arm 48, and openings for receiving bolts therein for fastening the front facing to element 45 can be formed in arm 48 which would have an extension similar to extension 50 if dowels or studs 46 were not utilized.

A vertically extended clamping lug or tongue 52 made of plastics is formed on the front wall 12 in the region of opening 44, clamping lug or tongue 52 extending parallel to wall 40 and at the distance from the front surface 54 of inner wall 40 in the intermediate space 53. The intermediate space 53 is open upwardly, downwardly and in the right-hand direction as viewed from FIG. 6 so that clamping lug or tongue 52 can elastically yield in the direction towards the front surface 54 of wall 40. The rear engaging arm 48 of engagement element 45 extends from above into intermediate space 53 and thereby can be engaged behind the clamping lug 52. The latter is loaded in the direction towards front surface 54 so that the rear engaging arm 48 of engagement element 45 is firmly pressed against front surface 54 of wall portion 40 of the front wall 12. If a pressing force is reduced the rear arm 48 of engagement element 45 can slide or yield with the play in the intermediate space 53 upon the movement of the front facing 16 so that this front facing would be able to adjust its position at all the sides.

With reference to FIGS. 5 and 6 it will be seen that clamping lug 52 has a supporting portion 55. Opening 44 has the width "b" in the upper region thereof between web 41 and web 42, which is smaller than the width of this opening in the remaining lower area thereof. The width of engagement element 45 corresponds opproximately to dimension "b" so that upon the movement of the engagement element for fastening the front facing 16 to the front wall 12 both webs 41 and 42 will effect an initial or zero position control in the horizontal direction. During the movement of engagement element 45 the lower end of rear engaging arm 48 will extend beyond the clamping lug 52. When the rear arm 48 of element 45 contacts the front surface 54 this will result in engagement of rear arm 48 with the back side of clamping lug 52 in the intermediate space 53 due to a relative displacement of the drawer 10 and front facing 16 downwardly. Since the distance in the transverse direction between webs 41 and 42 in the area of lug 52 is greater than the aforementioned width "b" the adjustment of the front facing 16 rightwardly and leftwardly in the horizontal direction of wall 12 is possible. The adjustment of the front facing in the vertical direction is also possible.

In order to fix clamping lug 52 after a necessary adjustment of the force acting on this lug has taken place a pin formed as a transversally extended bolt 56 with a head 57 and turnable from the side wall of the drawer 10 is provided. Bolt 56 is received and supported at two ends in the above mentioned supporting portion 55 and another supporting portion 58. Head 57 is positioned in the region of side wall 13, namely its outer wall 19 so that it is always accessible from outside of the drawer. Supporting portion 58 has a through bore 59 through which a cylindrical guide portion 60 of bolt 56 extends. The threaded portion 61 of bolt 56 is supported in threaded bore 62. When bolt 56 is fully inserted in clamping lug 52, as is the case of FIG. 6, the head 57 of the bolt is positioned in a depression 63 so that head 57 does not extend outwardly from outer wall 19 and at the same time it strikes against the base of depression 63 when the clamping movement is performed.

Bolt 56 is so formed that it is loaded in the direction of the right-angle deflection from the axial screw movement of the bolt towards the front surface 54 when the front facing 16 is tightened with the outer circumferential portions formed on bolt 56. These circumferential portions extended in the area of contact between bolt 56 and lug 52 are formed by a plurality of threads 64 which are positioned on bolt 56 between the threaded portion 61 and cylindrical guide portion 60 according to the embodiment of FIGS. 5–8. The outer diameter of the threads 64 at most corresponds to the diameter of through bore 59. The clamping lug 52 at the side thereof facing the bolt 56 has a number of semicircular and concave grooves, although such grooves are not necessary. Such grooves if they are provided in lug 52 are so dimensioned that the lug when it is not engaged with threads 64 projects further in the rightward direction so that intermediate space 53 can receive engaging arm 48 with a greater play-possibility. If bolt 56, as shown in FIG. 6, is inserted from the right-hand side into the lug 52 so far that the first thread 64 comes into contact with the respective side of lug 52 this thread will cut into lug 52. The latter thereby will bend elastically in the direction of front surface 54. Threads 64 also translate the screw movement of bolt 56 into the clamping movement of clamping lug 52 in the direction somewhat normal to the front surface 54 of wall 40. The clamping action ends when bolt 56 is fully inserted in the lug 52 and supporting portions 56 and 58 as shown in FIG. 6.

The front surface 54 of wall 40 has vertical grooves 65 whereas the rear arm 48 of engagement element 45 has corresponding vertical grooves 66 alternating with respective projections engaged in grooves 65.

The surface of clamping lug 52 and the surface of rear arm 48, which are in engagement with each other, have respective horizontal grooves 67 and 68.

Figure 9:
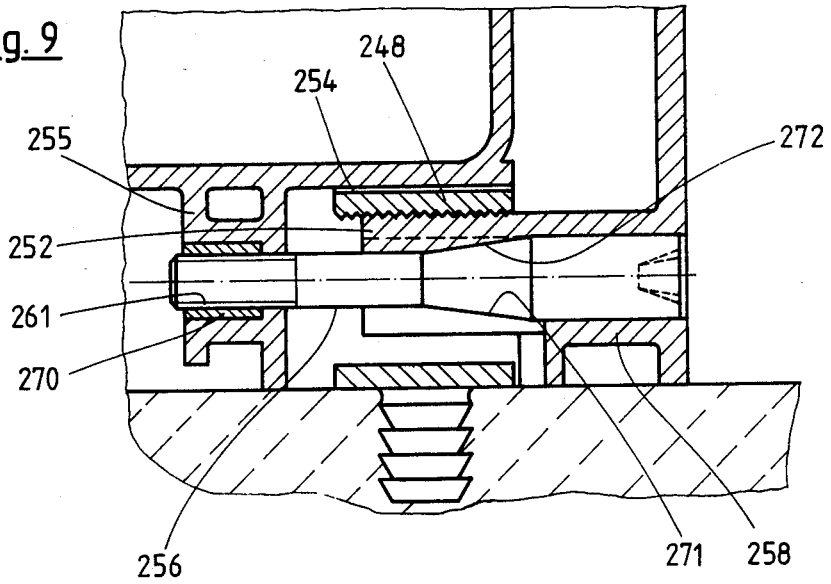
FIG. 9 is a partial sectional view corresponding to that of FIG. 6 but of a still another embodiment of the invention.

With reference to FIG. 9, which illustrates a third embodiment of the invention, the rear arm of the engagement element is denoted by reference character 248 while supporting portions for the clamping bolt 256 are designated by reference numerals 255 and 258, respectively. In the embodiment of FIG. 9 the clamping lug 252 is formed integral with the supporting portion 258 which is the portion of wall 19. Clamping lug 252 extends in the leftward direction from supporting portion 258. Bolt 256 has a threaded portion 261 inserted in a threaded bushing 270 mounted by means of a thread in the left-hand supporting portion 255. In this embodiment bolt 256 has no head but is supported in the respective guide bore formed in supporting portion 258.

The difference between the embodiment of FIG. 9 and that of FIGS. 5–8 resides in that the above-described circumferential portions of bolt 56 of FIG. 6 are formed in the embodiment of FIG. 9 by a conical portion 271 with a conical outer surface the outer diameter of which decreases in the direction of screwing of the bolt. A respective sloped contact surface 272 corresponding to the conical surface of portion 271 is provided in lug 252, which surface affects the right-angled deflection from the axial screw movement of the bolt towards the front surface 254. If bolt 256 is inserted into lug 252 and rotated the conical portion 271 is pressed against sloped surface 272 whereby clamping lug 252 yields in the direction of front surface 254 so that rear arm 248 of the engagement element is pressed against front surface 254. An angular or curved surface corresponding to conical portion 271 can be provided in place of sloped surface 272 to translate the axial movement of the bolt into the transverse movement of the lug. Furthermore, bolt 256 can be provided in place of conical portion 271 with a cylindrical portion of a greater diameter which would yield against the clamping lug and translate the axial movement of the bolt into the transverse movement of the lug towards front surface 254. It is believed that other conventional means suitable for translation of the axial movement of the bolt into the transverse clamping action of the lug could be utilized in the present invention.

The above described fashion of fastening the front facing to the body of the drawer has the advantage that it is very simple and inexpensive as compared to the manners of fastening the front facing of the drawer known in the art. The provision of the guide ledge of the design as shown in FIGS. 1–4 permits one to avoid the application of special adapters normally used with the guide ledges of the drawers.

It will be understood that each of the elements described above, or two or more together, may also find a useful application in other types of plastics drawers for furniture differing from the types described above.

While the invention has been illustrated and described as embodied in a plastics drawer for furniture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to the protected by Letters Patent is set forth in the appended claims:

1. In a drawer, made of plastics, for furniture, comprising a front wall, a rear wall, a bottom, a pair of side walls each being a double wall and including an inner wall and an outer wall spaced from each other to form a hollow space therebetween having a reverse-U cross-section, an upper end wall connecting the inner and outer walls to each other, and a guide ledge member in each side wall mounted therein to enclose said hollow space at a lower end thereof, said ledge member extending in the direction of elongation of the assigned side wall at least along the entire length of said hollow space and in a direction transverse to the direction of elongation from said inner wall to said outer wall, the improvement comprising that said inner wall having a first inner face facing said hollow space and said outer wall having a second inner face facing said hollow space, said first inner face and said second inner face being smooth and rib-free, and said ledge member including an upper horizontally extending arm projecting from said inner wall to said outer wall, said ledge member being releasably engageable with said inner wall in the region of said bottom wall, said upper arm having an underside forming a guide surface for guiding thereon a guide means connected to an article of furniture, said ledge member having a vertically extending another arm integral with said upper arm and projecting downwardly therefrom towards said bottom wall at least up to the level of said bottom wall, said another arm having a smooth face abutting against said inner face of said inner wall, said inner wall having an extension projected downwardly beyond said bottom wall; and means for a connection of said ledge member to said inner wall, said means including clamping tongues formed on said ledge member, and said extension having recesses in which said tongues are engaged whereby said ledge member is releasably connected to the drawer.

2. The drawer as defined in claim 1, wherein said ledge member is formed of metal.

3. The drawer as defined in claim 2, wherein said guide means connected to an article of furniture is a roll, said roll being adapted to ride on said guide surface.

4. The drawer as defined in claim 1, wherein said ledge member has an angular cross-section.

5. The drawer as defined in claim 1, wherein said ledge member has a lower horizontally extending arm integral with said vertically extending arm so that said ledge member has an S-shaped cross-section, said extension having an underside engaged with said lower arm.

6. The drawer as defined in claim 1, wherein said clamping tongues are open in the horizontal direction towards said front wall and each having a clamping portion received in the respective recess, said recesses being formed as openings open at the underside of said extension so that the clamping portion of each tongue is inserted from below into the respective opening.

7. The drawer as defined in claim 6, wherein said upper, bottom and side walls form a body of the drawer, said recesses each having a base, said body being supported in the vertical direction with the bases of said recesses on the respective clamping portion of said tongues.

8. The drawer as defined in claim 6, wherein each of said tongues further includes a hook-like bent portion.

9. The drawer as defined in claim 8, wherein each hook-like bent portion has an upper narrow side, the drawer being supported in the vertical direction on the upper narrow sides of said hook-like portions.

10. The drawer as defined in claim 7, wherein said rear wall is formed with a recess open rearwardly, the ledge member in the region of said rear wall having a clamping tongue engaged in said recess, said recess being formed by an upper wall portion, a lower wall portion, said tongue having a clamping portion overlapping said lower wall portion.

11. In a drawer made of plastics, for furniture, comprising a bottom; a front wall; a rear wall and a pair of side walls, a substantially smooth adjustable front facing releasably connected to said front wall, said front wall having an inner wall portion; and at least two connecting means for connecting the front facing to said front wall and each mounted at the end of the front wall and including an engagement member inserted between said front facing and said inner wall portion and including a front arm rigidly connected to the front facing, a rear engaging arm parallel to said inner wall portion and engageable therewith, and a rotatable pin insertable into the drawer transversally of the drawer, the improvement comprising that said pin being a bolt, said drawer being formed with two supporting wall portions having bores spaced from each other in the direction of an axis of said bolt, said bolt being supported in said bores and including at least one circumferential outwardly radially extending portion, the inner wall including a clamping lug having an outer surface engageable with said rear engaging arm and an inner surface engageable with said circumferential outwardly radially extending portion of said bolt when said bolt is inserted into the drawer whereby, upon rotation of said bolt for attaching said front facing to said front wall an axial movement of said bolt is translated via said circumferential outwardly extending portion and said clamping lug into a motion of said rear arm in the direction normal to said axial movement and towards said inner wall portion of said front wall so that said rear arm is forced into engagement with said said front wall and thus the front facing becomes attached to the front wall.

12. The drawer as defined in claim 11, wherein said bolt has an outer end accessible in the region of the respective side wall and has a threaded portion supported in one of said bores.

13. The drawer as defined in claim 12, wherein said bolt has at said outer end thereof a head, one of said supporting wall portions having a surface limiting the movement of the head of said bolt in the axial direction.

14. The drawer as defined in claim 11, wherein said front face of said inner wall portion is provided with grooves alternating with projections and said lug having respective grooves alternating with projections and engageable with the grooves and projections of said inner wall portion.

15. The drawer as defined in claim 11, wherein said lug of a side thereof facing said rear arm is provided with grooves alternating with projections and said rear arm at a side thereof facing said lug having grooves alternating with projections and engageable with the respective grooves and projections of said lug.

16. The drawer as defined in claim 11, wherein said lug is formed on one of said supporting wall portions, said bolt having a threaded portion screwed in another of said supporting wall portions and being inserted into said lug so that said lug is elastically yieldable in the direction transversal to said axial movement.

17. The drawer as defined in claim 11, wherein said circumferential radially outwardly extended portion of said bolt is formed by a cylindrical portion which, upon the axial movement of said bolt, displaces said lug towards said rear arm and said inner wall portion.

18. The drawer as defined in claim 17, wherein said cylindircal portion is provided with at least one thread thereon, said thread being cut in into the material of said lug whereby the latter is displaced towards said rear arm and said inner wall portion.

19. The drawer as defined in claim 11, wherein said circumferential radially outwardly extended portion of said bolt is formed by a conical portion which tapers in the direction of said axial movement, said lug having a conical contact surface engageable with said conical portion.

20. The drawer as defined in claim 11, wherein said lug has a contact surface engageable with said circumferential radially outwardly extended portion.

21. The drawer as defined in claim 20, wherein said contact surface is angular.

22. The drawer as defined in claim 20, wherein said contact surface is curved.

23. The drawer as defined in claim 20, wherein said contact surface is sloped.

24. The drawer as defined in claim 11, wherein said inner wall portion forms in said front wall for each engagement member a substantially rectangular opening, said bolt and said lug extending transversally of said opening, said engagement member being inserted into said opening above said bolt and said lug, said engagement member being fixable in said opening upon engagement of said lug with said rear arm.

25. The drawer as defined in claim 24, wherein said engagement member has an upper horizontally extended arm integral with said vertically extended rear arm, said opening having a predetermined width (b) in an upper region thereof, said upper arm in the horizontal direction having a width being greater than said predetermined width, said opening having below said upper region and in the area of said rear arm a width which is greater than said predetermined width.

26. The drawer as defined in claim 24, wherein said engagement member further includes a horizontally extended upper arm integral with said rear arm, and said front arm being integral with said upper arm and spaced from said rear arm so that the engagement member has a cross-section of inverted U.

27. The drawer as defined in claim 25, wherein dowels are provided for connecting said front facing to said engagement member.

28. The drawer as defined in claim 25, wherein bolts are provided for connecting said front facing to said engagement member.

29. The drawer as defined in claim 26, wherein said front arm has an upwardly projected extension, said extension being reinforced with ribs.

* * * * *